United States Patent [19]

Hehl

[11] 4,382,241

[45] May 3, 1983

[54] VALVE ADJUSTMENT UNIT FOR HYDRAULIC PROPORTIONAL-RESPONSE VALVE

[76] Inventor: Karl Hehl, Arthur-Hehl-Strasse 32, 7298 Lossburg 1, Fed. Rep. of Germany

[21] Appl. No.: 151,396

[22] Filed: May 19, 1980

[30] Foreign Application Priority Data

May 22, 1979 [DE] Fed. Rep. of Germany ..... 2920670
Sep. 1, 1979 [DE] Fed. Rep. of Germany ..... 2935468

[51] Int. Cl.[3] ..... H01H 3/28

[52] U.S. Cl. ..... 335/153; 335/202; 335/219; 335/260; 361/142

[58] Field of Search ..... 335/153, 202, 219, 220, 335/296, 299, 258, 260, 278; 251/54, 131; 137/625.65, 554; 361/142

[56] References Cited

U.S. PATENT DOCUMENTS 4,114,125 9/1978 Komatsu ..... 335/258

*Primary Examiner*—Stafford D. Schreyer
*Attorney, Agent, or Firm*—Joseph A. Geiger

[57] ABSTRACT

A valve adjustment unit for an electronically controlled hydraulic proportional-response valve comprising a proportional-response magnet unit, a coaxially connected electronic control unit, and an intermediate insulating spacer body surrounding the inductive coil of a displacement transducer. The magnet core of the transducer is carried by the push rod of the armature of the proportional-response magnet and arranged to move in the bore of an axial cover extension of the magnet unit housing which is open to the oil-filled armature displacement space. The transducer coil core is part of the electronic control unit, serving as a support for two circuit boards and as a cover for the control unit housing.

18 Claims, 9 Drawing Figures

VALVE ADJUSTMENT UNIT FOR HYDRAULIC PROPORTIONAL-RESPONSE VALVE

BACKGROUND OF THE INVENTION

1. Field of the Invention

The present invention relates to electromagnetically operated hydraulic valves, and, more particularly, to an adjustment unit for a hydraulic control valve, especially a proportional-response valve which serves for the continuous adjustment of either the pressure or the flow rate in conjunction with a hydraulic control circuit.

2. Description of the Prior Art

It is known to use electromagnetically controlled proportional-response control valves in hydraulic circuits, for the continuous adjustment of pressure values or flow rate values, either in response to a randomly preset input value, or in response to a changing input value, as in the case of a feedback loop arrangement.

The adjustment unit for such a proportional-response control valve includes a proportional-response electromagnet of the solenoid-type, with an armature which is guided for axial movements against a return spring. This proportional-response magnet unit is normally connected end-to-end to the housing of the control valve.

It is also known to extend the hydraulic space of the control valve into the magnet unit, so that the space which is occupied by the armature of the latter is filled with hydraulic fluid, thereby eliminating friction-producing seals between the control valve and the armature of the magnet unit.

Also known from the prior art is the arrangement of an inductive displacement transducer in conjunction with the proportional-response magnet unit, the displacement transducer consisting of a permanent magnet which is mounted on an axial extension of the push rod of the magnet armature and a stationary coil surrounding the transducer magnet. The coil is carried by a housing which is axially aligned with and attached to the housing of the magnet unit. Such an arrangement is disclosed in "o+p Ölhydraulik und Pneumatik", Vol. 21, No. 10, 1977, p. 722 ff. and in a paper by H. Walter in the periodical "fluid", Oct. 1978, pp. 28–34.

In this prior art device, the fluid-filled space around the armature of the proportional-response magnet is sealed off from the space which contains the inductive displacement transducer. This requires the presence of a sealing element which cooperates with the moving armature under axial friction. As a result of this friction, it has been found that this arrangement is subject to erratic movements, known as "stickslip" action, thereby distorting the axial displacements of the armature and the accuracy of operation of the control valve. An additional shortcoming of the above-described prior art device is the potential for misalignments in the mounting relationship between the coil of the inductive displacement transducer and the transducer magnet.

SUMMARY OF THE INVENTION

It is a primary objective of the present invention to propose an improvement in connection with a valve adjustment unit of the above-described type by eliminating the earlier-mentioned shortcomings, with the result that the improved valve device will operate with greater accuracy and reliability while being simplified in its structure to such an extent that it can be produced and assembled at the same or a lower cost than the known devices. Lastly, the improved device is to have compact overall dimensions.

The present invention proposes to attain these objectives by suggesting a valve adjustment unit which consists of two axially connected subassemblies: a proportional-response magnet unit and an electronic control unit, the displacement transducer of the magnet unit being arranged between the two units while forming an integral part of the magnet unit. This is accomplished by arranging the movement space for the transducer magnet in the form of an axial extension of the movement space of the proportional-response magnet, thereby extending the hydraulic space surrounding the magnet armature so as to also surround the transducer magnet.

The stationary enclosure surrounding the movement space of the transducer magnet is preferably a small-diameter integral extension of the housing of the magnet unit, reaching into the interior of the adjoining electronic control unit. The cooperating inductive coil of the displacement transducer is arranged to form a portion of the electronic control unit.

Among the advantages of this novel valve adjustment unit are its absence of the previously inevitable friction from a sliding seal between the magnet armature and the transducer magnet, the assured concentricity of the housing portion of the transducer magnet with the housing of the magnet armature, and compact, space-saving overall dimensions of the valve adjustment unit. The compactness of the device is the result of arranging the displacement transducer inside an integral housing extension of the proportional-response magnet unit and of giving this housing extension a very small diameter, so that it and its surrounding transducer coil will reach a distance into the interior of the electronic control unit, or into a heat-insulating spacer which is arranged between the magnet unit and the electronic control unit.

Accordingly, it is possible to run the electrical connecting lines between the electronic control unit and the magnet unit directly from the former to the latter, through appropriate apertures in the insulating spacer body. In contrast, the earlier-described known valve adjustment unit requires a separate location for the electronic control unit, suggesting location inside a control cabinet, for example. This prior art device also requires the arrangement of the inductive displacement transducer in the form of a separate structural unit which is attached to the proportional-response magnet unit. In the present invention, the displacement transducer is completely hidden away, its permanent magnet and surrounding housing portion being integrated in the magnet unit, and its induction coil being integrated in the electronic control unit.

The proposed arrangement of the valve adjustment unit of the invention, while thus being very compact and easy to accommodate in conjunction with a proportional-response control valve, brings with it a potential problem, however, inasmuch as the proportional-response magnet unit may develop a considerable amount of heat, under continuous operation. This heat buildup problem may make it necessary to arrange a heat-insulating element between the magnet unit and the electronic control unit. The invention therefore suggests for this purpose the use of a suitable non-metallic spacer body which conveniently surrounds the induction coil of the displacement transducer while axially aligning and centering the electronic control unit against the magnet unit.

The arrangement of the induction coil of the displacement transducer within a non-metallic insulating spacer body not only assures the protection of the coil against accidental damage and tampering, it also assures the absence of any metallic mass in the radial area outside the induction coil which might disturb the magnetic force field of the transducer magnet. The proposed spacer body thus serves a multiple purpose, and the present invention suggests that it be injection-molded from a high-polymer plastic.

The integration of the transducer coil with the electronic control unit is advantageously accomplished in such a way that the coil core forms a forwardly extending part of the front cover of the electronic control unit housing, with an appropriate recess for the extension of the magnet unit housing which encloses the transducer magnet. This combined cover and coil core preferably also serves as a snap-in support for the printed circuit boards of the electronic control unit.

The preferred embodiment of the invention further suggests a polygonal housing for the electronic control unit which can be inserted axially over the printed circuit boards and which is centered on a flange of the displacement transducer coil core and on a circuit board bracket which connects the rear extremities of the circuit boards. Attached to the circuit board bracket is a multi-line connector jack which cooperates with a matching connector plug which is removably attached to the rear side of the electronic control unit. The orientation of a multi-line cable which extends from the connector plug is adaptable to different angles, depending on the assembly requirements of the particular application of the valve adjustment unit.

BRIEF DESCRIPTION OF THE DRAWINGS

Further special features and advantages of the invention will become apparent from the description following below, when taken together with the accompanying drawings which illustrate, by way of example, a preferred embodiment of the invention which is represented in the various figures as follows.

DESCRIPTION OF THE PREFERRED EMBODIMENT

Figure 3:
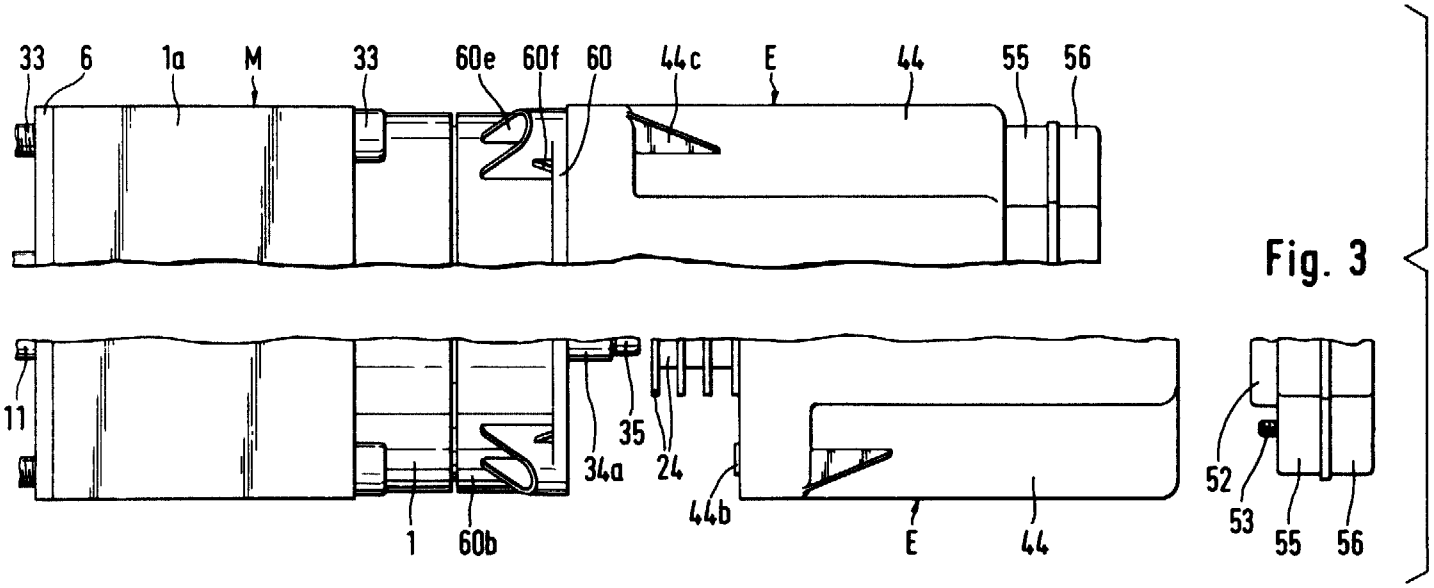
FIG. 3 is an external view of a complete valve adjustment unit, as suggested by the invention, consisting of a proportional-response magnet unit and an axially connected electronic control unit, the lower half of the figure showing the electronic control unit partially removed and disassembled.

As can best be seen in FIG. 3, the valve adjustment unit of the invention consists essentially of a proportional-response magnet unit which is designated by the letter M, and a coaxially attached electronic control unit which is designated by the letter E. Attached to the rear extremity of the electronic control unit E is a detachable connector plug 55, 56 which includes a multi-line cable 59 (FIG. 4).

Figure 1:
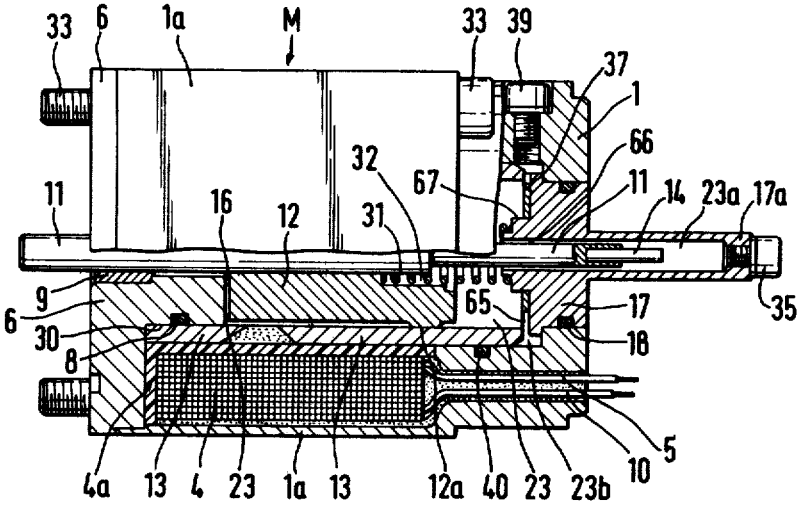
FIG. 1 represents a proportional-response magnet unit, as part of an embodiment of the present invention, portions of the unit being shown in a longitudinal cross section.
Figure 2:
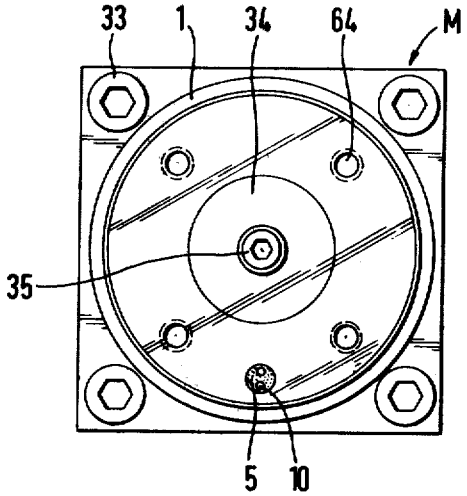
FIG. 2 shows the magnet unit of FIG. 1, as seen in an end view from the rear side thereof.

In FIGS. 1 and 2 it can be seen that the housing 1 of the proportional-response magnet unit M consists of a generally cylindrical housing rear portion and an adjoining axially forwardly extending square-tubular housing main portion, with clamping screws 33 arranged in the four corners of the tubular main portion. The clamping screws 33 are adapted to engage matching threaded bores of the proportional-response control valve to which the valve adjustment unit of the invention is to be attached.

Figure 4:
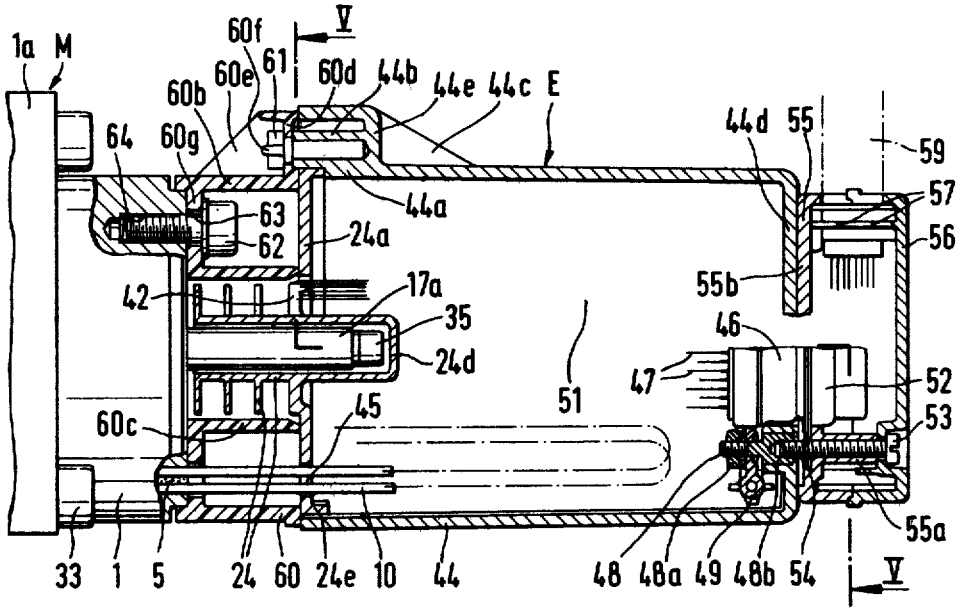
FIG. 4 shows the electronic control unit of FIG. 2 and portions of the attached magnet unit in a longitudinal cross section taken along line IV—IV of FIG. 5.

FIGS. 3 and 4 also show that the magnet unit M has attached to its rear side a heat-insulating spacer body 60, four screws 62 serving to clamp the spacer body 60 against a rear face of the magnet unit housing 1. The spacer body 60 has the general shape of a hollow annulus, or of a rearwardly open torus, consisting of concentric inner and outer tubular spacer walls 60*c* and 60*b*, respectively, a planar front end wall 60*g*, and a rear cover flange 60*d* of square outline extending radially from the outer spacer wall 60*b*. The front end wall 60*g* has holes for four screws 62 which clamp the spacer body 60 to the rear portion of the magnetic unit housing 1, engaging matching threaded bores 64 in the latter. A peripheral centering collar on the spacer body 60 cooperates with a matching recess on the magnet unit housing 1 to assure axial alignment of the parts.

The cover flange 60*d* of the spacer body 60 similarly serves for the centered attachment of the spacer body to the control unit housing 44, using four clamping screws 61, as indicated in FIG. 4. The four clamping screws 61 engage threaded sleeve-like axial extensions 44*b* of the control unit housing 44. The threaded extensions 44*b* are surrounded by radially protruding corner eye portions 44*e* of the housing 44, their outline matching the square outline of the cover flange 60*d* of the spacer body 60. U-shaped external ribs 60*e* reinforce the cover flange 60*d*, and diagonal corner ribs 44*c* stabilize the corner eye portions 44*e* of the control unit housing 44.

It may be desirable to prevent tampering with the valve adjustment unit after final assembly and testing. For this purpose, the clamping screws 61 and the surrounding U-shaped external ribs 60*e* have small bores through which a seal wire 60*f* can be inserted.

FIG. 1 shows that the armature of the proportional-response magnet unit M consists of a magnet core 12 which is seated on a push rod 11. This armature is guided for movements along the center axis of the unit by means of a push rod bushing 9 in the front housing cover 6 and by means of a plurality of guide faces 12*a* on the outer periphery of the magnet core 12, near its rear extremity, which cooperate with a smooth bore of an armature guide sleeve 13 surrounding the armature core 12. The push rod 11 penetrates into the adjoining proportional-response valve (not shown) where it engages the control plunger of the latter. The space surrounding the armature 12 communicates with the interior of the control valve through either an axial bore in the housing cover 6 or an axial groove in the push rod bushing 9.

The armature guide sleeve 13 carries on its outer periphery a coil supporting body 4*a* which, in turn, carries a magnet coil 4. The front end portion of the guide sleeve 13 is seated on a rearwardly extending centering shoulder 30 of the housing cover 6, and the rear end portion of the sleeve 13 is seated inside the rear portion of the magnet unit housing 1. The guide sleeve 13 thus also serves as a coil support and as a centering member between the front housing cover 6 and the magnet unit housing 1. The leads 10 for the magnet coil 4 extend rearwardly through an axial bore 5 of the housing 1 and through the spacer body 6 (FIG. 4) into the electronic control unit E. After assembly, the bore 5 is sealed off by means of a resin sealer.

Surrounding the magnet armature 12 is a displacement cavity 23 which is formed by the front end cover 6, the armature guide sleeve 13 and a rear cover 17 which is seated in an axial bore of the magnet unit housing 1. An O-ring 18 in a groove of the cover 17, and similar grooves and O-rings 8 and 40 in the shoulder 30 of the housing cover 6 and in the housing portion which seats the guide sleeve 13 provide seals for the displacement cavity 23. A closure disc 37 is arranged on a shoulder 67 on the front side of the rear cover 17, to serve as an abutment between the cover 17 and the armature guide sleeve 13. This disc has a localized peripheral recess which serves as a passage 65 from the interior of the guide sleeve 13 to an annular venting space 23*b* from which air can be vented by means of a radially oriented venting screw 39.

In the absence of an electric current in the magnet coil 4, the magnet armature 12 is held in a forward position, in abutment against the front housing cover 6, by means of a compression spring 31, a length portion of which is accommodated in an axial recess 32 of the magnet core 12. A small abutment disc 16 on the push rod 11 of the armature projects the armature core 12, when it abuts against the front housing cover 6.

The push rod 11 extends a distance beyond the rear side of the armature core 12, carrying on its rear extremity a cylindrical permanent magnet 14 which, as will be explained further below, forms part of an inductive displacement transducer, in cooperation with a surrounding stationary transducer coil. This rearwardly protruding push rod portion and its transducer magnet 14 are surrounded by a central bore 66 in the rear cover 17 of the magnet unit housing and in the tubular rearward extension 17*a* of the latter.

While the cover extension 17*a* has a relatively small outer diameter, its bore 66 does not contact the push rod 11 and magnet 14, thus leaving an annular gap around both. Accordingly, the displacement cavity 23 for the armature core 12 extends around and beyond the transducer magnet 14, in the form of a communicating magnet displacement cavity 23*a*, thus eliminating the need for a sliding seal on the push rod 11. A plug in the form of a venting screw 35 closes off the magnet displacement cavity 23*a* on the rear axial extremity of the cover extension 17*a*.

The fact that the armature guide sleeve 13 and the rear housing cover 17 are seated in concentric bores of the magnet unit housing 1 assures concentricity between the transducer magnet 14 and its surrounding tubular cover extension 17*a*. In the assembled state of the valve adjustment unit, the rearwardly protruding cover extension 17*a* of the magnet unit M is surrounded by an attached electronic control unit E and an intermediate spacer body, as will be described further below, in connection with FIGS. 3 and 4.

It has been found that, under continuous operation, the proportional-response magnet unit M may develop a considerable heat buildup, reaching a temperature between 110° C. and 160° C. This kind of temperature buildup may present a problem with regard to the consistency of operation of the amplifier circuits of the attached electronic control unit E, unless measures are taken to prevent the transmission of this heat from the magnet unit M to the electronic control unit E.

The valve adjustment unit of the present invention therefore features a heat-insulating spacer body 60 which is interposed between the proportional-response magnet unit M and the coaxially attached electronic control unit E. The spacer body 60 is a non-metallic body, preferably injection-molded of high-polymer plastic, which serves as a heat barrier and also protects the inductive coil of the displacement transducer. The latter is arranged on a coil core 24 which has an axially forwardly open bore surrounding the cover extension 17*a* of the magnet unit M in the assembled position. To the transducer coil core 24 is integrally connected a coil core flange 24*a* which forms a front cover for the electronic control unit E, in cooperation with the control unit housing 44. Because the axial cover extension 17*a* of the magnet unit M is longer than the axial extent of the transducer coil core 24, the latter extends a distance into the interior of the electronic control unit E itself, within a hollow cylindrical rearward protrusion 24*d* of the transducer coil core 24.

Figure 5:
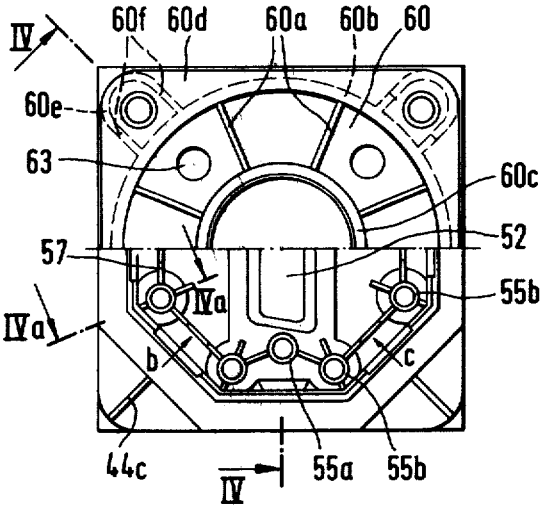
FIG. 5 shows details of the unit of FIG. 4, as seen in a two-plane transverse cross section taken along line V—V of FIG. 4.

The non-metallic spacer body 60, while having a hollow shape which gives it good insulating characteristics, is nevertheless very stiff and of stable shape, thanks in part to eight radial ribs 60*a* which extend between the outer spacer wall 60*b* and the inner spacer wall 60*c* (FIG. 5). The flange 24*a* of the transducer coil core 24 has an axial opening 45 through which extend the electrical leads for the core windings of the coil core 24.

Figure 8:
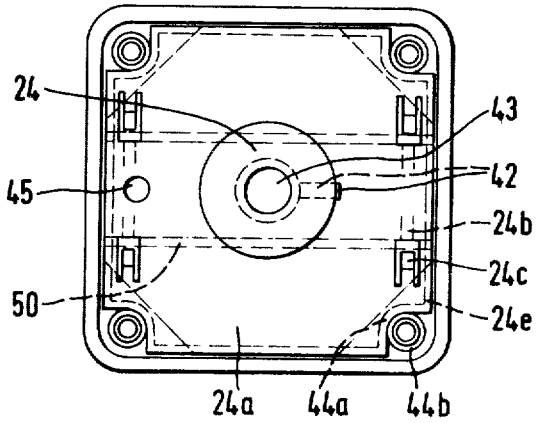
FIG. 8 is an end view of the unit of FIG. 6, as seen from the front side.

The coil core flange 24*a* is centered in relation to the control unit housing 44 by means of four corner recesses in its square outline which cooperate with the sides of the threaded extensions 44*b* of the corner eye portions 44*e* of housing 44 (FIG. 8). The transducer coil core 24 is also centered in relation to the spacer body 60 by fitting closely into the inner diameter of the inner spacer wall 60*c* of the latter.

In the axial sense, the coil core flange 24*a* abuts against the outer and inner spacer walls 60*b* and 60*c* of the spacer body 60 in the forward sense, and against recessed abutment noses 44*a* at the threaded extensions 44*b* in the rearward sense, having a reinforcing positioning rim 24*e* for this purpose. Just inside its positioning rim 24*e*, the coil core flange 24*a* has an axial opening 45 through which pass the supply leads 10 for the magnet coil 4 of the proportional-response magnet unit.

Figure 6:
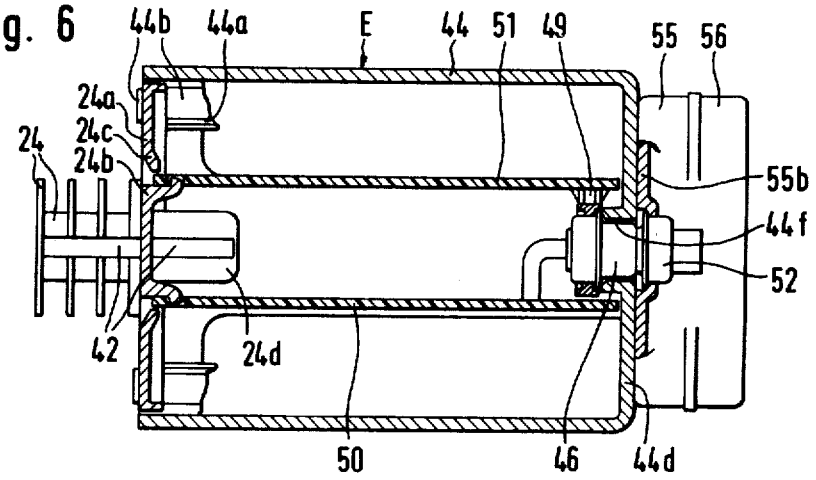
FIG. 6 shows a longitudinal cross section through the electronic control unit, taken in a plane which is perpendicular to the section plane of FIG. 5.
Figure 7:
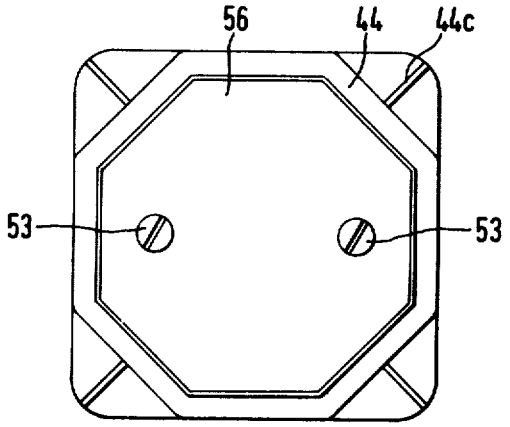
FIG. 7 is an end view of the control unit of FIG. 6, as seen from the rear side.

As can be seen in FIG. 6, the coil core flange 24*a* further serves as a support for two printed circuit boards 50 and 51 which extend parallel to the longitudinal axis of the electronic control unit E, on opposite sides of that axis. For this purpose, the coil core flange 24*a* has arranged in its radial wall two pairs of horizontally rearwardly extending holding noses 24*b* which cooperate with matching openings in the circuit boards 50 and 51. Facing the holding noses 24*b* are two pairs of cooperating holding tongues 24*c* which, due to surrounding cutouts in the coil core flange 24*a*, are elastically deformable so as to exert a pressure against the circuit boards 50 and 51 when they are engaged over the holding noses 24*b*.

The housing 44 of the electronic control unit E is generally pot-shaped, having an octagonal tubular wall and a transverse rear end wall 44*d* forming the bottom of the pot-shaped housing. In the center of the end wall 44*d* is arranged a rectangular aperture 44*f* with a surrounding inwardly projecting collar, for the accommodation of a multi-line connector jack 46.

FIG. 4 shows how the connector jack 46 is attached to a transversely oriented circuit board bracket 49 by means of two threaded anchoring studs 48 and clamping nuts 48*a*, the anchoring studs 48 having hexagonal head portions that reach into matching openings in the housing end wall 44*d*, laterally outside the aperture 44*f*, so as to present threaded bores for a pair of clamping screws 53 which hold a cooperating multi-line connector plug 52 in engagement with the connector jack 46. The rear extremities of the circuit boards 50 and 51 are attached to the transversely oriented circuit board bracket 49 by means of self-tapping screws (not shown).

The multi-line connector plug 52 is enclosed within two half-shells 55 and 56 of an octagonal connector, the screws 53 clamping the half-shells 55 and 56 axially against the end wall 44*d* of the control unit housing 44. Each of the two screws 53 has a groove holding a snap-type retainer ring 54 which secures the connector plug 52 against the inner half-shell 55, thereby also retaining the screws 53 in the connector and aiding in the disengagement of the multi-line connector, when the screws 53 are unscrewed from their threads in the anchoring studs 48.

Figure 4A:
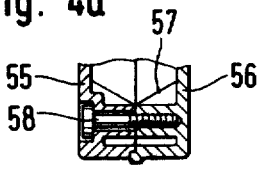
FIG. 4*a* shows a detail of the connector plug of FIG. 4, in a cross section taken along line IV*a*—IV*a* of FIG. 5.

The two half-shells 55 and 56 are separately clamped together by means of screws 58, as shown in FIG. 4*a*. There, it can also be seen that the shell-halves 55 and 56 include cable clamping ribs 57 which hold the multi-line cable 59 (FIG. 4) against traction forces, thereby protecting the line connections in the connector plug 52. The connector half-shells 55 and 56 are so arranged that the cable 59 can enter the connector in different radial orientations, as indicated by the arrows "b" and "c" in FIG. 5, depending on the availability of space in the particular application of the valve control unit. The multi-line connector jack 46, containing a large number of connector pins, is so arranged that, with the connector plug 52 removed, it is flush with the housing end wall 44*d* of the electronic control unit E. The cooperating connector plug 52 of the connector 55, 56 is similarly flush with the abutting end wall 55*b* of the inner half-shell 55.

In the course of assembling the electronic control unit E, the electronic circuit boards 50 and 51 are first engaged at their forward extremities with the holding noses 24*b* and the holding tongues 24*c* of the coil core flange 24*a*. This is accomplished by inclining the two circuit boards 50 and 51 in such a way that their front edges can be inserted between the holding noses and holding tongues. After insertion, the circuit boards 50 and 51 are pivoted into parallel alignment and their rear extremities are clamped to the circuit board bracket 49 which then forms a bridge between the two circuit boards. Attached to the circuit board bracket 49 is the multi-line connector jack 46 and its threaded anchoring studs 48. At this assembly stage, the transducer coil core 24, the circuit boards 50 and 51 with their circuitry components, and the circuit board bracket 49 with the connector jack 46 form a stable circuit board sub-unit.

Following attachment of the heat-insulating spacer body 60 to the rear extremity of the proportional-response magnet unit M, the circuit board sub-unit is joined to the spacer body 60 by inserting the transducer coil core 24 into the bore of the inner spacer wall 60*c* of the spacer body 60 and over the cover extension 17*a* of the magnet unit housing 1. With the electronic control unit housing 44 still removed, the electrical connections between the magnet unit M and the electronic control unit E can be completed, so that the assembled unit can be tested by inserting the multi-line connector plug 52 into the connector jack 46. At this stage, all the circuitry components and connections of the electronic control unit E are still accessible for inspection and tuning adjustments.

Following the completion of all tests and adjustments on the open electronic control unit E, the connector plug 52 is again removed, whereupon the control unit housing 44 can be inserted axially over the circuit board sub-unit and clamped against the cover flange 60*d* of the spacer body 60. The tightened clamping screws 61 are then secured by means of the seal wire 60*f*. At the time of final installation of the valve control unit in the production machine, it may be necessary to reorient the radial direction of the multi-line cable 59. As described earlier, this can be accomplished in a simple procedure by removing the cable connector, by releasing its clamping screws 58, and by separating the shell-halves 55 and 66 for a reorientation of the cable 59.

It should be understood, of course, that the foregoing disclosure describes only a preferred embodiment of the invention and that it is intended to cover all changes and modifications of this example of the invention which fall within the scope of the appended claims.

I claim the following:

1. A valve adjustment device adapted for attachment to an electronically controlled hydraulic proportional-response valve which has a valve body and a cooperating valve plunger defining a common longitudinal axis for said valve and the valve adjustment device, said device comprising in combination:

a proportional-response magnet unit of the solenoid-type having a magnet coil which surrounds an axially movable armature and a magnet unit housing which encloses the magnet coil and the armature, while forming a sealed displacement cavity for the armature, the magnet unit housing having a forward axial side on which it is sealingly attachable to said body of the proportional-response valve, for a coaxial drive connection between the magnet armature and the valve plunger and for hydraulic communication between the armature displacement cavity and a fluid-filled interior space of the proportional-response valve; and an inductive displacement transducer arranged coaxially with the magnet unit, on its rearward axial side, the displacement transducer including a transducer coil which is fixedly mounted outside the magnet unit housing, in alignment with the unit axis, and a permanently magnetized transducer magnet which is movable in the central aperture of the transducer coil, being carried by a rod which extends axially rearwardly from the armature; and wherein the magnet unit housing has a tubular rearward extension which reaches through the aperture of the transducer coil, while forming an enclosed magnet displacement cavity around the transducer magnet; and the armature displacement cavity of the magnet unit communicates with the magnet displacement cavity of the displacement transducer via a gap around the magnet-carrying rod, with the result that the transducer magnet is, in effect, enclosed within the magnet unit housing and surrounded by the same hydraulic fluid which surrounds the armature.

2. A valve adjustment device as defined in claim 1, wherein the communicating displacement cavities for the armature and the transducer magnet are ventable by means of a venting screw which closes off an axial opening at the rearward extremity of the tubular extension of the magnet unit housing.

3. A valve adjustment device as defined in claim 2, wherein the displacement cavity of the armature is additionally ventable by means of a venting screw which closes off a radial opening in the wall of the magnet unit housing.

4. A valve adjustment device as defined in claim 1, further comprising:

an electronic control unit for the adjustable supply of electric power to the proportional-response magnet unit, the electronic control unit being connectable to the rearward axial side of the magnet unit housing and arranged to at least partially enclose the displacement transducer, the electronic control unit forming a subassembly which includes the transducer coil as part thereof.

5. A valve adjustment device as defined in claim 4, wherein the transducer coil includes a transducer coil core supporting the windings of the transducer coil;

the electronic control unit includes a control unit housing;

the electronic control unit further includes at least one circuit board extending axially inside the control unit housing, having its forward edge portion attached to the transducer coil core.

6. A valve adjustment device as defined in claim 5, wherein the transducer coil core has an enlarged disc-like flange portion extending substantially across the width of the control unit housing in the manner of a transverse wall;

the electronic control unit includes two substantially parallel spaced circuit boards of generally rectangular outline which are arranged on opposite sides of the valve axis, the forward extremities of the circuit boards and the flange portion of the transducer coil core defining circuit board attachment means for the fastener-free attachment of the circuit boards to the coil core flange portion;

the electronic control unit further includes a circuit board bracket forming a connection between the rear extremities of the circuit board;

the transducer coil core and its attached circuit boards and circuit board bracket are attachable to the magnet unit in the absence of the control unit housing, thereby forming a readily accessible cantilevered shelf-like assembly; and the control unit housing is pot-shaped and axially insertable over said shelf-like assembly.

7. A valve adjustment device as defined in claim 6, wherein the circuit board attachment means includes at least two transversely spaced openings near the forward edge of each circuit board, an equal number of hook-like holding noses extending rearwardly from the coil core flange portion so as to engage the circuit board openings from radially inside, and an equal number of holding tongues formed by the coil core flange portion so as to bear elastically against the forward edges of the circuit boards from radially outside; and the holding noses and holding tongues are so shaped that the forward edges of the circuit boards can be inserted between then when the circuit boards are inclined away from each other.

8. A valve adjustment device as defined in claim 6 or claim 7, wherein the transducer coil core has an axially extending tubular wall portion which is engageable over the tubular extension of the magnet unit housing.

9. A valve adjustment device as defined in claim 8, wherein the tubular wall portion of the transducer coil core extends rearwardly a distance beyond the coil core flange portion and radially between the circuit boards, the tubular wall portion including a closure wall at its rear extremity.

10. A valve adjustment device as defined in claim 6 or claim 7, wherein the electronic control unit further includes a multiline connector jack supported by the circuit board bracket near the rearward extremity of the control unit housing; and the control unit housing has a transverse rear wall with an aperture providing access to the connector jack.

11. A valve adjustment device as defined in claim 10, wherein the connector jack is attached to the circuit board bracket by means of a plurality of threaded anchoring studs which have head portions engaging matching centering bores in the rear wall of the control unit housing;

the electronic control unit further includes a multiline connector plug which is insertable into the connector jack; and the connector plug includes means for securing it in the inserted position.

12. A valve adjustment device as defined in claim 11, wherein the connector plug securing means is in the form of a plurality of fasteners which engage the head portions of the threaded anchoring studs of the connector jack.

13. A valve adjustment device as defined in claim 11, wherein the connector plug includes two half-shells with clamping ribs which serve to position and secure a radially extending multi-line cable, the half-shells being arranged to allow for the selective clamping of the cable in one of several radial orientations.

14. A valve adjustment device as defined in any one of claims 4 through 6, further comprising a spacer body of relatively poorly heat-conductive material interposed axially between the proportional-response magnet unit and the electronic control unit, the spacer body surrounding at least an axial length portion of the transducer coil.

15. A valve adjustment device as defined in claim 14, wherein the spacer body has a generally C-shaped rotational cross section formed by a substantially cylindrical inner spacer wall, a radially extending forward end wall, and an outer spacer wall at a radial distance from the inner spacer wall; and the inner spacer wall of the spacer body surrounds the transducer coil, serving as a protective casing for the latter and as a centering member for the transducer coil core.

16. A valve adjustment device as defined in claim 14, wherein the spacer body is clampable to a rear face of the magnet unit housing by means of fasteners; and the spacer body further includes a radially outwardly extending cover flange near its rear extremity, for the centered attachment thereto of the control unit cover.

17. A valve adjustment device as defined in claim 1, wherein the proportional-response magnet unit includes, as part of its armature, a central push rod and an armature body attached thereto, the push rod carrying the transducer magnet on its rear extremity;

the magnet unit housing includes a front housing cover with a guide bushing for the push rod; and the magnet unit further includes an armature guide sleeve which surrounds the armature body and cooperates with peripheral guide faces near the rear edge of the armature body.

18. A valve adjustment device as defined in claim 17, wherein the armature further includes a spring which exerts an axial bias on the armature.

* * * * *